US010590674B1

(12) United States Patent
Herman

(10) Patent No.: US 10,590,674 B1
(45) Date of Patent: Mar. 17, 2020

(54) ROTATING HEADSTONE

(71) Applicant: Richard Herman, Banning, CA (US)

(72) Inventor: Richard Herman, Banning, CA (US)

( * ) Notice: Subject to any disclaimer, the term of this patent is extended or adjusted under 35 U.S.C. 154(b) by 0 days.

(21) Appl. No.: 16/161,249

(22) Filed: Oct. 16, 2018

(51) Int. Cl.
*E04H 13/00* (2006.01)

(52) U.S. Cl.
CPC ..... *E04H 13/003* (2013.01)

(58) Field of Classification Search
CPC ..... E04H 13/00; E04H 13/003; E04H 13/008
See application file for complete search history.

(56) References Cited

U.S. PATENT DOCUMENTS 2,436,631 A * 2/1948 Cohn ..... E04H 13/003 47/41.1
2,523,824 A * 9/1950 Haase ..... E04H 13/001 52/66
2,710,491 A * 6/1955 Carlson ..... E04H 13/003 47/41.1
3,798,855 A 3/1974 Walker
4,790,088 A * 12/1988 Morvant ..... G09F 19/22 40/124.5
5,553,426 A * 9/1996 Ostergaard ..... E04H 13/003 40/124.5
5,657,586 A 8/1997 Bezler
6,094,871 A * 8/2000 Arnold ..... E04H 13/003 40/124.5
6,414,663 B1 * 7/2002 Manross, Jr. ..... A61G 17/08 345/87
8,555,561 B2 10/2013 Dickinson
9,074,387 B2 * 7/2015 Camp, Jr. ..... E04H 13/003
2003/0037492 A1 * 2/2003 Rodrigues ..... E04H 13/003 52/103
2006/0123714 A1 * 6/2006 Sannipoli, Sr. ..... E04H 13/003 52/103
2010/0205872 A1 * 8/2010 Leyden ..... E04H 13/003 52/103

* cited by examiner

*Primary Examiner* — Paola Agudelo
(74) *Attorney, Agent, or Firm* — Kyle A. Fletcher, Esq.

(57) ABSTRACT

The rotating headstone comprises a headstone, a rotator, and a top cover. The rotator may move the headstone between a vertical position and a horizontal position to move the headstone out of the way of landscaping crews and equipment. The rotator may comprise a plurality of pistons that expand and contract to move the top and bottom of the headstone and racks and pinions to guide the bottom of the headstone. In the horizontal position, the headstone may lie within a shell that is below ground level. When in the vertical position, the headstone may be exposed above ground and the top cover may cover the opening left by the vertical headstone. The repositioning may be initialed by a local button or by a wireless remote control. The rotator may be powered by one or more batteries which are kept charged by one or more solar cells.

17 Claims, 3 Drawing Sheets

ROTATING HEADSTONE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of headstones, more specifically, a rotating headstone.

SUMMARY OF INVENTION

The rotating headstone comprises a headstone, a rotator, and a top cover. The rotator may move the headstone between a vertical position and a horizontal position to move the headstone out of the way of landscaping crews and equipment. The rotator may comprise a plurality of pistons that expand and contract to move the top and bottom of the headstone and racks and pinions to guide the bottom of the headstone. In the horizontal position, the headstone may lie within a shell that is below ground level. When in the vertical position, the headstone may be exposed above ground and the top cover may cover the opening left by the vertical headstone. The repositioning may be initialed by a local button or by a wireless remote control. The rotator may be powered by one or more batteries which are kept charged by one or more solar cells.

An object of the invention is to rotate a headstone between a vertical position and a horizontal position and vice versa.

Another object of the invention is to move the headstone using a plurality of pistons, racks, and pinions.

A further object of the invention is to power the rotator from one or more batteries that are charged by one or more solar cells.

Yet another object of the invention is to provide a local button and a remote control for initialing the rotation of the headstone.

These together with additional objects, features and advantages of the rotating headstone will be readily apparent to those of ordinary skill in the art upon reading the following detailed description of the presently preferred, but nonetheless illustrative, embodiments when taken in conjunction with the accompanying drawings.

In this respect, before explaining the current embodiments of the rotating headstone in detail, it is to be understood that the rotating headstone is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the rotating headstone.

It is therefore important that the claims be regarded as including such equivalent construction insofar as they do not depart from the spirit and scope of the rotating headstone. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
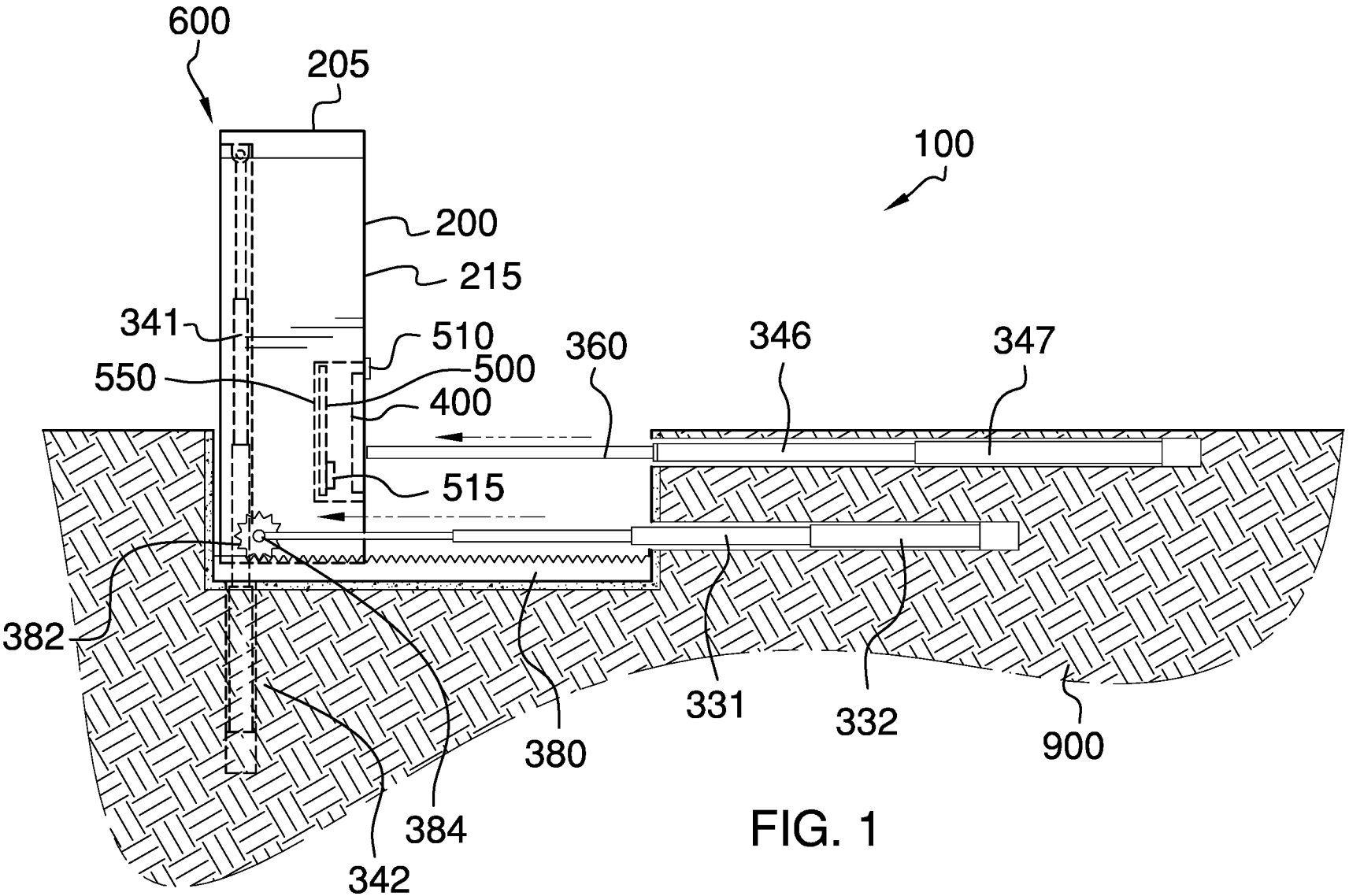
FIG. 1 is a side view of an embodiment of the disclosure illustrating the headstone in the vertical position.
Figure 2:
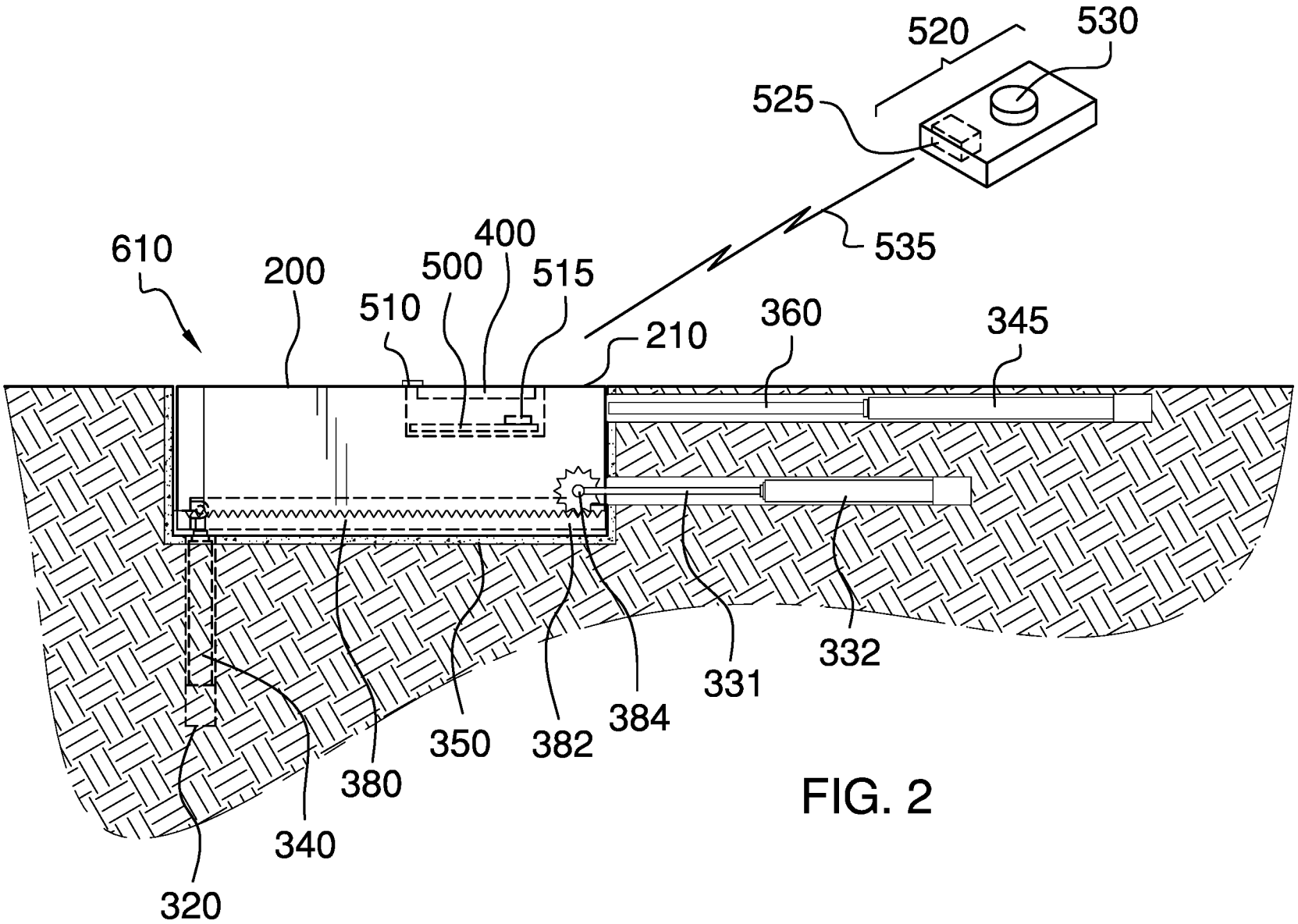
FIG. 2 is a side view of an embodiment of the disclosure illustrating the headstone in the horizontal position.
Figure 3:
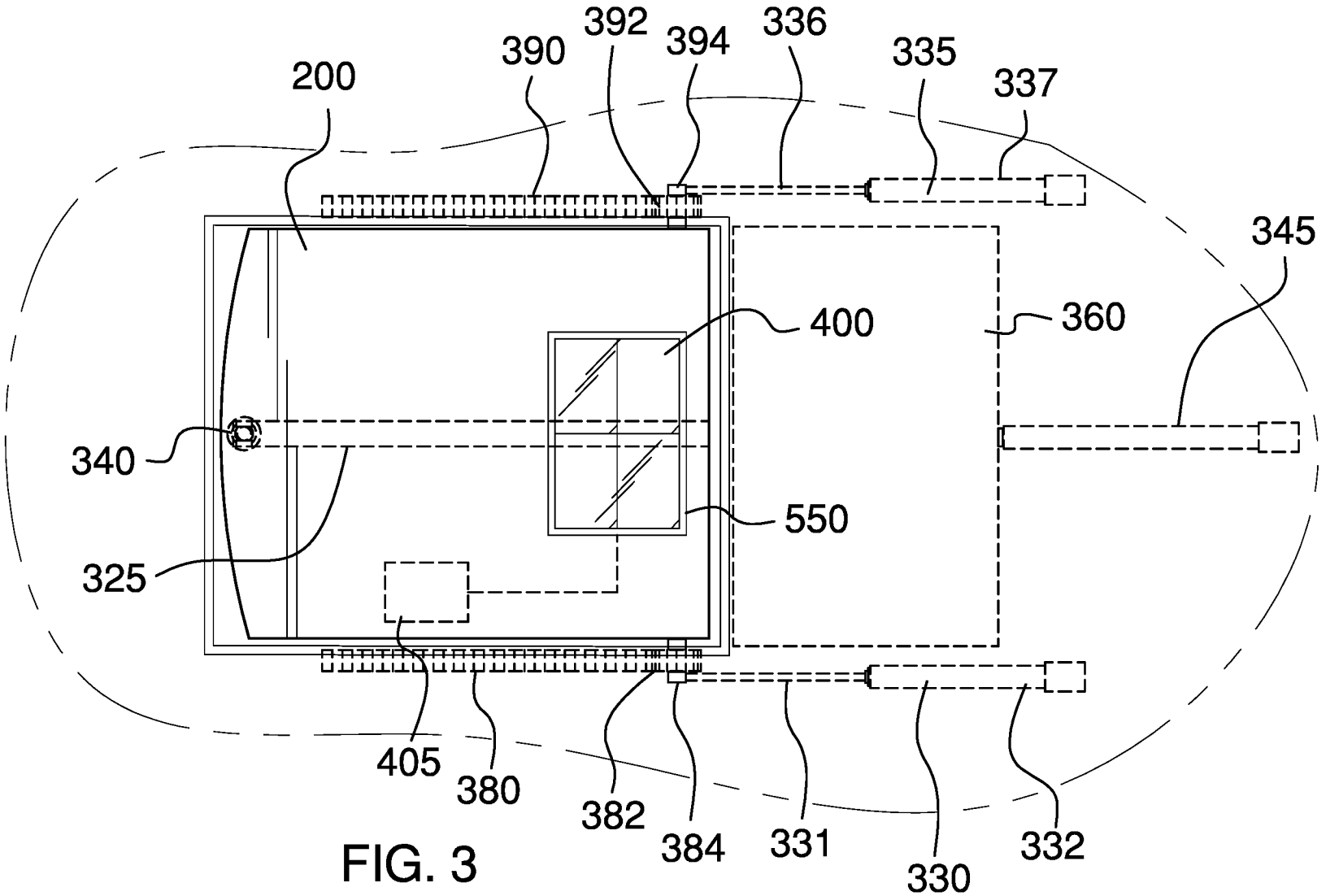
FIG. 3 is a top view of an embodiment of the disclosure illustrating the headstone in the horizontal position.

Detailed reference will now be made to a first potential embodiment of the disclosure, which is illustrated in FIGS. 1 through 3.

The rotating headstone 100 (hereinafter invention) comprises a headstone 200, a rotator, and a top cover 360. The rotator may transition the headstone 200 between a vertical position 600 and a horizontal position 610. When the headstone 200 is in the vertical position 600 it may be an upright, visible marker of the site of a grave. When the headstone 200 is in the horizontal position 610 it may be out of the way of landscaping and maintenance equipment.

The headstone 200 may be a grave marker. The headstone 200 may be engraved, inscribed, painted, or otherwise marked with identification and/or personal information on a front face 215 of the headstone 200. As a non-limiting example, the headstone may be a rectangular slab of stone such as granite. However, the invention 100 is not limited to a single shape or composition of the headstone 200.

The rotator may rotate and/or translate the position of the headstone 200. Specifically, the rotator may re-orient the headstone 200 between the vertical position 600 and the horizontal position 610. In the vertical position 600, the headstone 200 may be vertically oriented with a top of the headstone 205 above a bottom of the headstone 210. In the horizontal position 610, the headstone 200 may be horizontally oriented with the top of the headstone 205 at the same height as the bottom of the headstone 210. In the horizontal position 610, the front face 215 of the headstone 200 may be flush with ground 900. In some embodiments, the position of the bottom of the headstone 210 of the headstone 200 may be translated horizontally in the process of rotating the headstone 200.

The rotator may comprise a center piston 340, a left piston 330, a right piston 335, a left rack 380, a right rack 390, a left pinion 382, a right pinion 392, and a shell 350.

The center piston 340 may be an actuator that lifts the top of the headstone 205. The center piston 340 may comprise a center piston rod 341 and a center piston barrel 342. The center piston barrel 342 may be mounted in a fixed position and the center piston rod 341 may expand and contract under the influence of a control signal, thus changing the overall length of the center piston 340. The end of the center piston rod 341 may be hingedly coupled to the top, rear of the headstone 200. The center piston barrel 342 may be vertically oriented within a piston well 320 located under the center of the headstone 200. The center piston 340 may fit into a piston depression 325 on the rear of the headstone 200 when the headstone 200 is in the vertical position 600.

The left piston 330 may be an actuator that pushes and pulls the bottom of the headstone 210. The left piston 330 may comprise a left piston rod 331 and a left piston barrel 332. The left piston barrel 332 may be mounted in a fixed position and the left piston rod 331 may expand and contract under the influence of the control signal, thus changing the overall length of the left piston 330. The end of the left piston rod 331 may be coupled to a left axle 384. The left piston barrel 332 may be horizontally oriented in front of the left side of the shell 350. The left piston rod 331 may extend into the shell 350 to couple with the left axle 384.

The right piston 335 may be an actuator that pushes and pulls the bottom of the headstone 210. The right piston 335 may comprise a right piston rod 336 and a right piston barrel 337. The right piston barrel 337 may be mounted in a fixed position and the right piston rod 336 may expand and contract under the influence of the control signal, thus changing the overall length of the right piston 335. The end of the right piston rod 336 may be coupled to a right axle 394. The right piston barrel 337 may be horizontally oriented in front of the right side of the shell 350. The right piston rod 336 may extend into the shell 350 to couple with the right axle 394.

The left rack 380 may be a toothed rail that the left pinion 382 rides upon. The left rack 380 may be horizontally oriented at the bottom of the shell 350 along the left side of the shell 350.

The right rack 390 may be a toothed rail that the right pinion 392 rides upon. The right rack 390 may be horizontally oriented at the bottom of the shell 350 along the right side of the shell 350.

The left pinion 382 may be a gear that rides upon the left rack 380. The left pinion 382 may be rotationally coupled to the left axle 384. The left axle 384 may be coupled to left side of the headstone 200 at the bottom rear corner of the headstone 200. The left axle 384 may be horizontally oriented and may extend laterally from the headstone 200.

The right pinion 392 may be a gear that rides upon the right rack 390. The right pinion 392 may be rotationally coupled to the right axle 394. The right axle 394 may be coupled to right side of the headstone 200 at the bottom rear corner of the headstone 200. The right axle 394 may be horizontally oriented and may extend laterally from the headstone 200. The left axle 384 may be longitudinally aligned with the right axle 394 such that the headstone 200 may pivot at the axis formed by the left axle 384 and the right axle 394.

As non-limiting examples, the center piston 340, the left piston 330, and the right piston 335 may be hydraulic pistons or electrically operated linear actuators.

The headstone 200 may be moved from the horizontal position 610 to the vertical position 600 by expanding the center piston 340, the left piston 330, and the right piston 335. As the center piston 340 pushes the top of the headstone 200 up, the left piston 330 and the right piston 335 push the bottom of the headstone 200 to the rear. The headstone 200 may be moved from the vertical position 600 to the horizontal position 610 by contracting the center piston 340, the left piston 330, and the right piston 335. As the left piston 330 and the right piston 335 pull the bottom of the headstone 200 forward, the center piston 340 lowers the top of the headstone 200. The bottom of the headstone 200 is supported by the left axle 384, the left pinion 382, the right axle 394, and the right pinion 392 as it moves.

The top cover 360 may be a rigid panel that provides a level surface in front of the headstone 200 by covering the shell 350 when the headstone 200 is in the vertical position 600. The top cover 360 may be horizontally oriented and may be located in front of the shell 350 when the top cover 360 is retracted. The top cover 360 may be moved horizontally by a cover piston 345. The cover piston 345 may be an actuator that pushes and pulls the top cover 360. The cover piston 345 may comprise a cover piston rod 346 and a cover piston barrel 347. The cover piston barrel 347 may be mounted in a fixed position and the cover piston rod 346 may expand and contract under the influence of the control signal, thus changing the overall length of the cover piston 345. The end of the cover piston rod 346 may be coupled to the front edge of the top cover 360. The cover piston barrel 347 may be horizontally oriented in front of the center of the shell 350. The top cover 360 may move towards the headstone 200 to cover the shell 350 when the cover piston 345 expands and the top cover 360 may move away from the headstone 200 when the cover piston 345 contracts. The cover piston 345 may be activated in coordination with the center piston 340, the left piston 330, and the right piston 335 to prevent interference between the position of the headstone 200 and position of the top cover 360 and to assure that the shell 350 is always covered while the headstone 200 is in the vertical position 600.

A control circuit 500 may control the activation of the center piston 340, the left piston 330, and the right piston 335. The invention 100 may comprise a first control button 510 mounted on the headstone 200. Responsive to a depression of the first control button 510, the control circuit 500 may cause the center piston 340, the left piston 330, and the right piston 335 to rotate the headstone 200. Specifically, if the headstone 200 is in the vertical position 600 when the first control button 510 is pressed then the headstone 200 may move to the horizontal position 610 and if the headstone 200 is in the horizontal position 610 when the first control button 510 is pressed then the headstone 200 may move to the vertical position 600.

The control circuit 500 may be mounted within a control circuit housing. In some embodiments, the control circuit housing may be located within a cavity 550 in the headstone 200.

The invention 100 may further comprise a remote control 520. The remote control 520 may be a battery operated, hand-held control that wirelessly communicates with the control circuit 500. A transmitter 525 within the remote control 520 may be activated by depressing a second control button 530 located on the remote control 520. Activating the transmitter 525 may cause the remote control 520 to send a wireless signal 535 to a receiver circuit 515 within the control circuit 500. Responsive to receiving the wireless signal 535 at the receiver circuit 515, the control circuit 500 may cause the center piston 340, the left piston 330, and the right piston 335 to rotate the headstone 200. Specifically, if the headstone 200 is in the vertical position 600 when the wireless signal 535 is received then the headstone 200 may move to the horizontal position 610 and if the headstone 200 is in the horizontal position 610 when the wireless signal 535 is received then the headstone 200 may move to the vertical position 600.

The shell 350 may be a liner for a subsurface depression in the ground 900 where the invention 100 is installed. The shell may comprise a plurality of side walls and a bottom surface. The shell 350 may be composed of a rigid material. As non-limiting examples, the shell 350 may be composed of plastic, concrete, metal, polymer resin, a composite material, or combinations thereof. In some embodiments, the shell 350 may provide drainage holes on the bottom surface.

One or more batteries 405 may comprise one or more energy-storage devices. The one or more batteries 405 may be a source of electrical energy to operate the center piston 340, the left piston 330, the right piston 335 and the control circuit 500. The one or more batteries 405 may be replaceable or rechargeable.

In some embodiments, one or more solar cells 400 may provide current to recharge the one or more batteries 405. The one or more solar cells 400 may be located on any surface of the headstone 200 or on a combination of surfaces of the headstone 200.

In use, the invention 100 is installed in the subsurface depression in the ground 900 at the head of the grave. From the vertical position 600, the first control button 510 or the second control button 530 on the remote control 520 may be used to signal the control circuit 500 to activate the center piston 340, the left piston 330, and the right piston 335 to rotate the headstone 200 back to the horizontal position 610 and to retract the top cover 360. While in the headstone 200 is in the horizontal position 610 the headstone 200 may be out of the way of landscaping and maintenance crews. From the horizontal position 610, the first control button 510 or the second control button 530 on the remote control 520 may be used to signal the control circuit 500 to activate the center piston 340, the left piston 330, and the right piston 335 to rotate the headstone 200 forward to the vertical position 600 and to extend the top cover 360. While in the vertical position 600 the headstone 200 is displayed as the grave marker.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "axle" is a cylindrical shaft that is inserted through the center of an object such that the center axis of the object and the center axis of the axle are aligned and the object can rotate using the axle as an axis of rotation.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used in this disclosure, a "cavity" is an empty space or negative space that is formed within an object.

As used herein, the words "couple", "couples", "coupled" or "coupling", refer to connecting, either directly or indirectly, and does not necessarily imply a mechanical connection.

As used in this disclosure, the term "flush" is used to describe that a first surface is aligned with a second surface.

As used herein, "front" indicates the side of an object that is closest to a forward direction of travel under normal use of the object or the side or part of an object that normally presents itself to view or that is normally used first. "Rear" or "back' refers to the side that is opposite the front.

As used in this disclosure, a "gear" is a toothed wheel, cylinder, or other toothed mechanical element that is used to transmit motion, a change of speed, or a change of direction to second toothed wheel, cylinder, rack, or other toothed or slotted mechanical element.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, a "housing" is a rigid casing that encloses and protects one or more devices.

As used in this disclosure, the word "lateral" refers to the sides of an object or movement towards a side. Lateral directions are generally perpendicular to longitudinal directions. "Laterally" refers to movement in a lateral direction.

As used herein, the word "longitudinal" or "longitudinally" refers to a lengthwise or longest direction.

As used herein, the words "painted" or "tinted" refer to a change of coloration produced using paint, ink, dyes, or other coloring agents. The method of producing such a coloration change may include pens, brushes, stamps, stencils, or other methods of applying a coloring agent.

As used herein, the word "pivot" is intended to include any mechanical arrangement that allows for rotational motion. Non-limiting examples of pivots may include hinges, holes, posts, dowels, pins, points, rods, shafts, balls, and sockets, either individually or in combination.

As used here, "rack" refers to a cogged or toothed bar or rail that engages with a gear or pinion. Rotation of the gear may cause movement of the rack or movement of the gear along the rack. Alternatively, linear motion of the rack may cause rotation of the gear.

As used in this disclosure, "remote control" refers to the establishment of control of a device from a distance or to the controlling device itself. Remote control is generally accomplished through the use of an electrical device that generates electrically based control signals that are transmitted via radio frequencies to the device. Some remote controls may use infrared light to communicate with a device.

As used in this disclosure, a "rod" is a straight structure in which two dimensions of the structure appear thin relative to a third dimension of the straight structure.

As used in this disclosure, a "shell" is a structure that forms an outer covering intended to contain an object. Shells are often, but not necessarily always, rigid or semi-rigid structures that are intended to protect the object contained within it. Some shells may only partially cover the exterior surface of the object.

As used in this disclosure, "vertical" refers to a direction that is parallel to the local force of gravity. Unless specifically noted in this disclosure, the vertical direction is always perpendicular to horizontal.

As used in this disclosure, "wireless" is an adjective that is used to describe a communication channel that does not require the use of physical cabling.

With respect to the above description, it is to be realized that the optimum dimensional relationship for the various components of the invention described above and in FIGS. 1 through 3, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A rotating headstone comprising:

a headstone, a rotator, and a top cover;

wherein the rotator transitions the headstone between a vertical position and a horizontal position;

wherein when the headstone is in the vertical position it is an upright, visible marker of the site of a grave;

wherein when the headstone is in the horizontal position it is out of the way of landscaping and maintenance equipment;

wherein the rotator rotates and translates the position of the headstone between the vertical position and the horizontal position;

wherein in the vertical position, the headstone is vertically oriented with a top of the headstone above a bottom of the headstone;

wherein in the horizontal position, the headstone is horizontally oriented with the top of the headstone at the same height as the bottom of the headstone;

wherein in the horizontal position, a front face of the headstone is flush with ground;

wherein the position of the bottom of the headstone of the headstone is translated horizontally in the process of rotating the headstone;

wherein the rotator comprises a center piston, a left piston, a right piston, a left rack, a right rack, a left pinion, a right pinion, and a shell;

wherein the center piston is an actuator that lifts the top of the headstone;

wherein the center piston comprises a center piston rod and a center piston barrel;

wherein the center piston barrel is mounted in a fixed position and the center piston rod expands and contracts under the influence of a control signal, thus changing the overall length of the center piston;

wherein the end of the center piston rod is hingedly coupled to the top, rear of the headstone;

wherein the center piston barrel is vertically oriented within a piston well located under the center of the headstone;

wherein the center piston fits into a piston depression on the rear of the headstone when the headstone is in the vertical position.

2. The rotating headstone according to claim 1 wherein the left piston is an actuator that pushes and pulls the bottom of the headstone;

wherein the left piston comprises a left piston rod and a left piston barrel;

wherein the left piston barrel is mounted in a fixed position and the left piston rod expands and contracts under the influence of the control signal, thus changing the overall length of the left piston;

wherein the end of the left piston rod is coupled to a left axle;

wherein the left piston barrel is horizontally oriented in front of the left side of the shell;

wherein the left piston rod extends into the shell to couple with the left axle.

3. The rotating headstone according to claim 2 wherein the right piston is an actuator that pushes and pulls the bottom of the headstone;

wherein the right piston comprises a right piston rod and a right piston barrel;

wherein the right piston barrel is mounted in a fixed position and the right piston rod expands and contracts under the influence of the control signal, thus changing the overall length of the right piston;

wherein the end of the right piston rod is coupled to a right axle;

wherein the right piston barrel is horizontally oriented in front of the right side of the shell;

wherein the right piston rod extends into the shell to couple with the right axle.

4. The rotating headstone according to claim 3 wherein the left rack is a toothed rail that the left pinion rides upon;

wherein the left rack is horizontally oriented at the bottom of the shell along the left side of the shell;

wherein the right rack is a toothed rail that the right pinion rides upon;

wherein the right rack is horizontally oriented at the bottom of the shell along the right side of the shell.

5. The rotating headstone according to claim 4 wherein the left pinion is a gear that rides upon the left rack;

wherein the left pinion is rotationally coupled to the left axle;

wherein the left axle is coupled to left side of the headstone at the bottom rear corner of the headstone;

wherein the left axle is horizontally oriented and extends laterally from the headstone.

6. The rotating headstone according to claim 5 wherein the right pinion is a gear that rides upon the right rack;

wherein the right pinion is rotationally coupled to the right axle;

wherein the right axle is coupled to right side of the headstone at the bottom rear corner of the headstone;

wherein the right axle is horizontally oriented and extends laterally from the headstone;

wherein the left axle is longitudinally aligned with the right axle such that the headstone pivots at the axis formed by the left axle and the right axle.

7. The rotating headstone according to claim 6 wherein the center piston, the left piston, and the right piston are hydraulic pistons or electrically operated linear actuators.

8. The rotating headstone according to claim 6 wherein the headstone is moved from the horizontal position to the vertical position by expanding the center piston, the left piston, and the right piston;

wherein as the center piston pushes the top of the headstone up, the left piston and the right piston push the bottom of the headstone to the rear;

wherein the headstone is moved from the vertical position to the horizontal position by contracting the center piston, the left piston, and the right piston;

wherein as the left piston and the right piston pull the bottom of the headstone forward, the center piston lowers the top of the headstone;

wherein the bottom of the headstone is supported by the left axle, the left pinion, the right axle, and the right pinion as it moves.

9. The rotating headstone according to claim 8 wherein the top cover is a rigid panel that provides a level surface in front of the headstone by covering the shell when the headstone is in the vertical position;

wherein the top cover is horizontally oriented and is located in front of the shell when the top cover is retracted;

wherein the top cover is moved horizontally by a cover piston;

wherein the cover piston is an actuator that pushes and pulls the top cover;

wherein the cover piston comprises a cover piston rod and a cover piston barrel;

wherein the cover piston barrel is mounted in a fixed position and the cover piston rod expands and contracts under the influence of the control signal, thus changing the overall length of the cover piston;

wherein the end of the cover piston rod is coupled to the front edge of the top cover;

wherein the cover piston barrel is horizontally oriented in front of the center of the shell;

wherein the top cover moves towards the headstone to cover the shell when the cover piston expands and the top cover moves away from the headstone when the cover piston contracts;

wherein the cover piston is activated in coordination with the center piston, the left piston, and the right piston to prevent interference between the position of the headstone and position of the top cover and to assure that the shell is always covered while the headstone is in the vertical position.

10. The rotating headstone according to claim 9 wherein a control circuit controls the activation of the center piston, the left piston, and the right piston;

wherein the rotating headstone comprises a first control button mounted on the headstone;

wherein responsive to a depression of the first control button, the control circuit causes the center piston, the left piston, and the right piston to rotate the headstone;

wherein if the headstone is in the vertical position when the first control button is pressed then the headstone moves to the horizontal position and if the headstone is in the horizontal position when the first control button is pressed then the headstone moves to the vertical position.

11. The rotating headstone according to claim 10 wherein the control circuit is mounted within a control circuit housing.

12. The rotating headstone according to claim 11 wherein the control circuit housing is located within a cavity in the headstone.

13. The rotating headstone according to claim 10 wherein the rotating headstone comprises a remote control;

wherein the remote control is a battery operated, handheld control that wirelessly communicates with the control circuit;

wherein a transmitter within the remote control is activated by depressing a second control button located on the remote control;

wherein activating the transmitter causes the remote control to send a wireless signal to a receiver circuit within the control circuit;

wherein responsive to receiving the wireless signal at the receiver circuit, the control circuit causes the center piston, the left piston, and the right piston to rotate the headstone;

wherein if the headstone is in the vertical position when the wireless signal is received then the headstone moves to the horizontal position and if the headstone is in the horizontal position when the wireless signal is received then the headstone moves to the vertical position.

14. The rotating headstone according to claim 13 wherein the shell is a liner for a subsurface depression in the ground where the rotating headstone is installed;

wherein the shell comprises a plurality of side walls and a bottom surface;

wherein the shell is composed of a rigid material.

15. The rotating headstone according to claim 14 wherein the shell provides drainage holes on the bottom surface.

16. The rotating headstone according to claim 14 wherein one or more batteries comprise one or more energy-storage devices;

wherein the one or more batteries are a source of electrical energy to operate the center piston, the left piston, the right piston and the control circuit;

wherein the one or more batteries are replaceable or rechargeable.

17. The rotating headstone according to claim 16 wherein one or more solar cells provide current to recharge the one or more batteries;

wherein the one or more solar cells are located on any surface of the headstone or on a combination of surfaces of the headstone.

* * * * *